US006529208B1

(12) United States Patent
Chun et al.

(10) Patent No.: US 6,529,208 B1
(45) Date of Patent: Mar. 4, 2003

(54) METHOD AND APPARATUS FOR UPDATING A WINDOW IDENTIFICATION BUFFER IN A DATA PROCESSING SYSTEM

(75) Inventors: Sung Min Chun, Austin, TX (US); Richard Alan Hall, Round Rock, TX (US); George Francis Ramsay, III, Cedar Park, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/478,304

(22) Filed: Jan. 6, 2000

(51) Int. Cl.[7] ..... G09G 5/00
(52) U.S. Cl. ..... 345/629; 345/626
(58) Field of Search ..... 345/626, 629, 345/630, 631, 632, 634, 638, 639, 640, 641, 606, 607, 421, 422, 426, 427, 428, 503, 563, 602; 382/162, 163, 164, 165, 166, 167, 194

(56) References Cited

U.S. PATENT DOCUMENTS 4,555,775 A * 11/1985 Pike ..... 345/790
5,204,664 A * 4/1993 Hamakawa ..... 345/602
5,513,300 A * 4/1996 Shibazaki ..... 358/1.13
5,574,836 A * 11/1996 Broemmelsiek ..... 345/427
5,831,615 A * 11/1998 Drews et al. ..... 345/768
5,841,420 A * 11/1998 Kaply et al. ..... 345/421
5,850,232 A * 12/1998 Engstrom et al. ..... 345/539
5,926,188 A * 7/1999 Kawamoto et al. ..... 345/629
5,977,980 A * 11/1999 Aleksicy ..... 345/422
6,118,427 A * 9/2000 Buxton et al. ..... 345/629
6,147,695 A1 * 11/2001 Bowen et al. ..... 345/403

* cited by examiner

*Primary Examiner*—Michael Razavi
*Assistant Examiner*—Thu-Thao Havan
(74) *Attorney, Agent, or Firm*—Duke W. Yee; Mark E. McBurney

(57) ABSTRACT

A method and apparatus in a data processing system for updating a buffer used to display pixels from a first layer and a second layer in the data processing system, wherein identification display information for pixels from the first layer and the second layer are stored in the buffer. Pixels are identified for the second layer having opaque pixel types to form a selected set of pixels. Overwriting of display information is prevented for the selected set of pixels in the buffer when updating the buffer.

16 Claims, 7 Drawing Sheets

WID COLOR BUFFER
666611111111111
666611155555111
777771155555111
777771155555111
777771155555111
777771111111111
FIG. 1
WID OVERLAY BUFFER
001111111222222
001111111000222
221111111000222
222222200000222
222222200000222
222222222222222
FIG. 2
SCREEN
661111111222222
661111111555222
221111111555222
222222255555222
222222255555222
222222222222222
FIG. 3
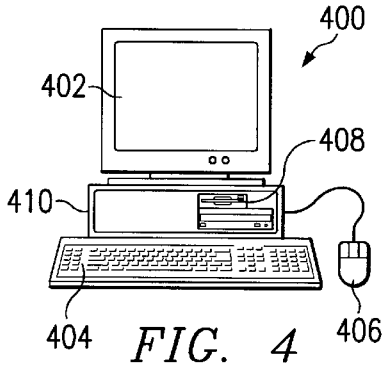
FIG. 4
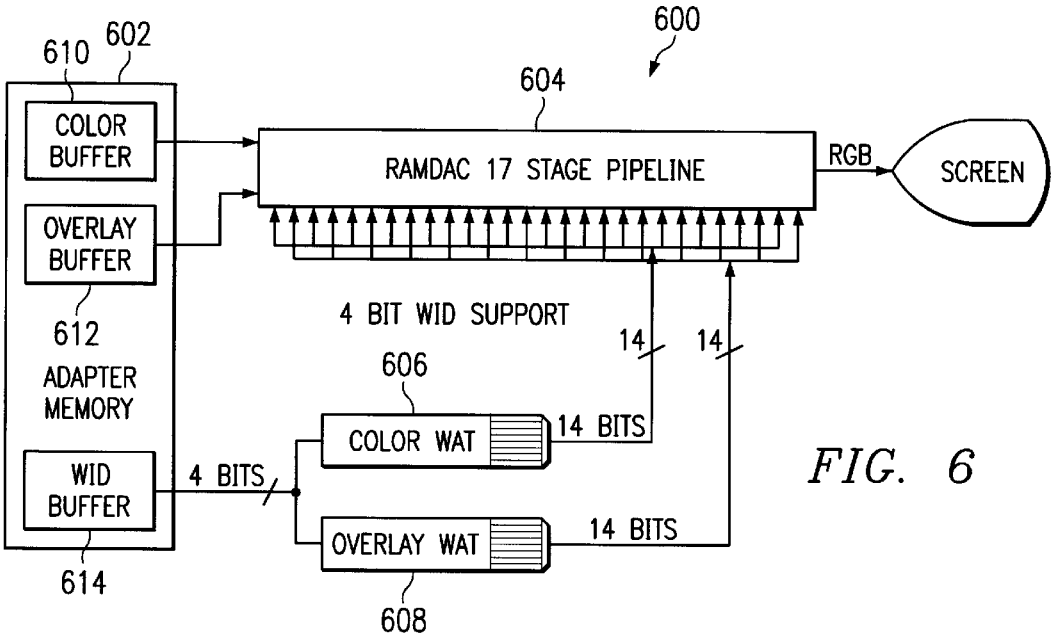
FIG. 6

700

| COLOR WAT | | | | | | OVERLAY WAT | | |
|---|---|---|---|---|---|---|---|---|
| WID | PIXEL TYPE | COLORMAP | BUFFER | GAMMA | | PIXEL TYPE | COLORMAP | TRANSPARENT |
| 0 | | | | | | 8 | 0 | 2 |
| 1 | | | | | | 8 | 2 | 2 |
| 2 | | | | | | 8 | 3 | 2 |
| 3 | | | | | | 8 | 1 | 2 |
| 4 | | | | | | 8 | 2 | 2 |
| 5 | 8 | 0 | 0 | | | 8 | 4 | 1 |
| 6 | 8 | 4 | 0 | | | 8 | 4 | 1 |
| 7 | 24 | 3 | 0 | | | 8 | 4 | 1 |
| 8 | 24 | 2 | 0 | | | 8 | 4 | 1 |
| 9 | 8 | 1 | 0 | | | 8 | 4 | 1 |
| a | 8 | 4 | 0 | | | 8 | 4 | 1 |
| b | 8 | 4 | 0 | | | 8 | 4 | 1 |
| c | 8 | 3 | 0 | | | 8 | 4 | 1 |
| d | 8 | 2 | 0 | | | 8 | 4 | 1 |
| e | 24 | 1 | 0 | | | 8 | 4 | 1 |
| f | 8 | 0 | 0 | | | 8 | 4 | 1 |

*FIG. 7*

1300

```
if( (pVWID->WID >= FIRST_COLOR_WID) &&
    (pVWID->WID <= MAX_COLOR_WID_VALUE)   ) {
    (* pScreen->Subtract) (&pWidRec->to_add,
                           &pWidRec->to_add,
                           &pScrnPriv->olMask) ;
```

1304

*FIG. 13B*

```
typedef struct {
        short           x1,x2,y1,y2;
}BoxRec,BoxPtr*;

typedef struct _RegData {
        long            size;
        long            numRects;
/*      BoxRec          rects[size]; in memory but not explicitly
declared */
}

typedef struct _Region {
        BoxRec          extents;
        RegDataPtr      data;
}RegionRec,RegionPtr*;
```

*FIG. 13A*

1300

```
/*****************************************************************************
* NAME:        UpdateOverlyRegionMask                                        *
*                                                                            *
* IN: region                                                                 *
*     pWin                                                                   *
*                                                                            *
* OUT: region                                                                *
*                                                                            *
* Description: This function will union all mapped OPAQUE OVERAY regions     *
*              which include the windows border and its cliplist. It         *
*              will traverse pWin and all of its children and return an      *
*              OPAQUE OVERAY region mask                                     *
*****************************************************************************/
void UpdateOverlyRegionMask(pScreen,region,pWin)
ScreenPtr pScreen;
RegionPtr region;
WindowPtr pWin;
{
     ColormapPtr          pColormap;
     VisualPtr            pVisual;
     RegionRec            borderRegion;

  if(!pWin) {
     return;
  }else{
     pColormap = (ColormapPtr) LookupIDByType (wColormap(pWin),
    RT_COLORMAP);
     pVisual = pColormap->pVisual;

     if(pWin->layer && !pVisual->transparent_type) {
       if(pWin->mapped) {
            if (pWin->borderWidth) {
              (* pScreen->RegionInit) (&borderRegion, NullBox, 0);
              (* pScreen->Subtract) (&borderRegion, &pWin->borderClip,
  &pWin->winSize);
              (* pScreen->Union) (region, region, &borderRegion);
              (* pScreen->RegionDestroy) (&borderRegion);
            }
            (* pScreen->Union) (region, region, &pWin->clipList)
          }
     }

     pWin = pWin->firstChild

     while(pWin) {
       UpdateOverlyRegionMask(pScreen,region,pWin);
       pWin = pwin->nextSib;
     }

   } /* if(!pWin) */
}
```

1302

METHOD AND APPARATUS FOR UPDATING A WINDOW IDENTIFICATION BUFFER IN A DATA PROCESSING SYSTEM

CROSS REFERENCE TO RELATED APPLICATIONS

The present invention is related to applications entitled METHOD AND APPARATUS IN A DATA PROCESSING SYSTEM FOR INSTALLING APPROPRIATE WID VALUES FOR A TRANSPARENT REGION, Ser. No. 09/478,302, and METHOD AND APPARATUS IN A DATA PROCESSING SYSTEM FOR UPDATING COLOR BUFFER WINDOW IDENTIFIERS WHEN AN OVERLAY WINDOW IDENTIFIER IS REMOVED, Ser. No. 09/478,303, which are filed even date hereof, assigned to the same assignee, and incorporated herein by reference.

BACKGROUND OF THE INVENTION

1. Technical Field

The present invention relates generally to an improved data processing system and in particular to a method and apparatus for displaying pixels in a data processing system. Still more particularly, the present invention provides a method and apparatus for updating a window identification buffer used to display pixels in a data processing system.

2. Description of Related Art

Computer graphics concerns the synthesis or display of real or imaginary objects from computer-based models. In computer graphics systems, images are displayed on a display device to a user in two dimensional and three dimensional forms. These images are displayed using pixels. A pixel is short for a picture element. One spot in a rectilinear grid of thousands of such spots that are individually "painted" to form an image produced on the screen by a computer or on paper by a printer. A pixel is the smallest element that display or print hardware and software can manipulate in creating letters, numbers, or graphics. These pixels and information relating to these pixels are stored in a buffer. The information describing a pixel is identified using a window ID (WID). A WID is used as an index into a window attribute table (WAT). The WAT contains information describing how a pixel will be displayed on the screen. For example, a WAT identifies depth, color map, buffer, and gamma for a pixel.

Typically, the WID is drawn into a separate buffer, which is used to describe how the pixels in the frame buffer or buffers will be rastered. Some graphic systems, such as, for example, UNIX servers, use overlays to enhance the performance of three dimensional applications, which need to be overlaid on top of a three dimensional application. An example of such is a menu. These type of servers typically require a separate WID buffer for the color planes and overlays to allow for the WIDs to be saved and restored. In FIG. 1, an example of data in a portion of a WID color buffer is illustrated. FIG. 2 is an example of data in a portion of a WID overlay buffer. In these two examples, each of the numbers illustrates a WID, which is used as an index into a WAT to identify information used to display a pixel associated with the WID. In FIG. 2, a zero is used to indicate that the overlay is disabled.

Typically, an eight bit split WID may be identified in hardware in which three bits are used to identify the WID for the overlay buffer and in which five bits are used to identify the WID for the color buffer. For example, the first three bits are used as an index into an overlay WAT while the lower five bits are used as an index into a color WAT. With three bits, eight WID entries may be identified or assigned to a pixel using the WID overlay buffer. Thirty-two different WID entries may be assigned to pixels using the WID color buffer. In this manner, a WID for a color buffer may be painted to the frame buffer without overwriting the WID in the overlay buffer. FIG. 3 illustrates resulting WIDs that would be used to display the pixels on a screen.

In manufacturing graphics chips, it is cheaper to fabricate a graphics chip without split WIDs. In such a case, only one WID buffer and two frame buffers are required. The problem with this structure is that rendering color buffer WIDs may result in overwriting of opaque overlay WIDs because only one WID buffer is provided, rather than two.

Therefore, it would be advantageous to have an improved method and apparatus for rendering pixels using a single WID buffer.

SUMMARY OF THE INVENTION

The present invention provides a method and apparatus in a data processing system for updating a buffer used to display pixels from a first layer and a second layer in the data processing system, wherein identification display information for pixels from the first layer and the second layer are stored in the buffer. Pixels are identified for the second layer having opaque pixel types to form a selected set of pixels. Overwriting of display information is prevented for the selected set of pixels in the buffer when updating the buffer.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 1 is an example of data in a portion of a WID color buffer;

FIG. 2 is an example of data in a portion of a WID overlay buffer;

FIG. 3 illustrates resulting WIDs that would be displayed on a screen;

FIG. 4 is a pictorial representation of a data processing system in which the present invention may be implemented in accordance with a preferred embodiment of the present invention;

FIG. 6 is a block diagram illustrating a graphics adapter in accordance with a preferred embodiment of the present invention;

FIG. 7 is an example of a WAT table in accordance with a preferred embodiment of the present invention;

FIGS. 13A and 13B are diagrams of code used to traverse windows and create an overlay region mask depicted in accordance with a preferred embodiment of the present invention.

DETAILED DESCRIPTION OF THE PREFERRED EMBODIMENT

Figure 5:
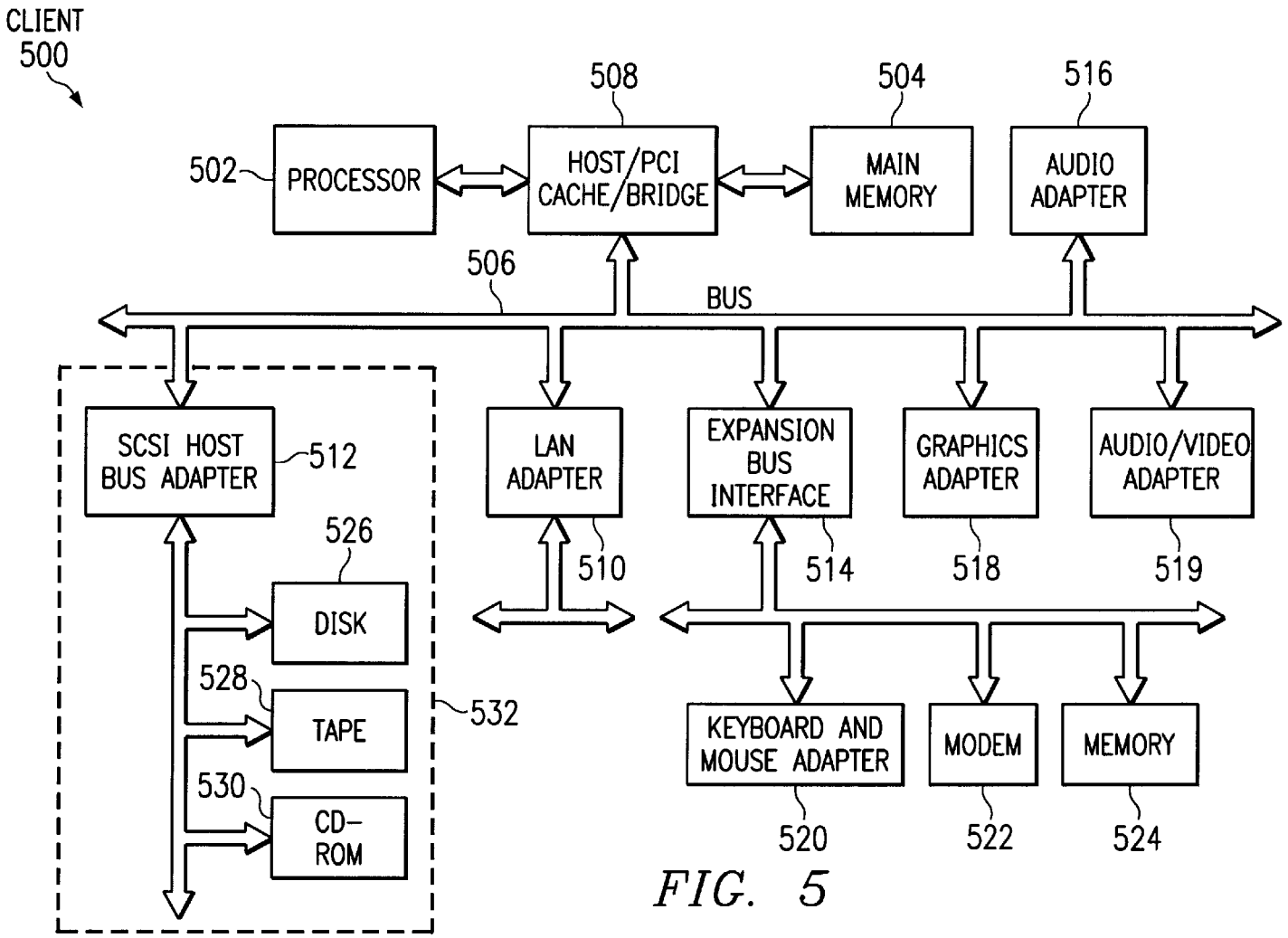
FIG. 5 is a block diagram illustrating a data processing system in which the present invention may be implemented in accordance with a preferred embodiment of the present invention.

With reference now to the figures and in particular with reference to FIG. 4, a pictorial representation of a data processing system in which the present invention may be implemented is depicted in accordance with a preferred embodiment of the present invention. A computer 400 is depicted which includes a system unit 410, a video display terminal 402, a keyboard 404, storage devices 408, which may include floppy drives and other types of permanent and removable storage media, and mouse 406. Additional input devices may be included with personal computer 400. Computer 400 can be implemented using any suitable computer, such as an IBM RS/6000 computer or IntelliStation computer, which are products of International Business Machines Corporation, located in Armonk, N.Y. Although the depicted representation shows a computer, other embodiments of the present invention may be implemented in other types of data processing systems, such as a network computer. Computer 400 also preferably includes a graphical user interface that may be implemented by means of systems software residing in computer readable media in operation within computer 400.

With reference now to FIG. 5, a block diagram illustrates a data processing system in which the present invention may be implemented. Data processing system 500 is an example of a computer, such as computer 400 in FIG. 4, in which code or instructions implementing the processes of the present invention may be located. Data processing system 500 employs a peripheral component interconnect (PCI) local bus architecture. Although the depicted example employs a PCI bus, other bus architectures such as Accelerated Graphics Port (AGP) and Industry Standard Architecture (ISA) may be used. Processor 502 and main memory 504 are connected to PCI local bus 506 through PCI bridge 508. PCI bridge 508 also may include an integrated memory controller and cache memory for processor 502. Additional connections to PCI local bus 506 may be made through direct component interconnection or through add-in boards. In the depicted example, local area network (LAN) adapter 510, small computer system interface SCSI host bus adapter 512, and expansion bus interface 514 are connected to PCI local bus 506 by direct component connection. In contrast, audio adapter 516, graphics adapter 518, and audio/video adapter 519 are connected to PCI local bus 506 by add-in boards inserted into expansion slots. The processes of the present invention may be used to manage rendering of data by graphics adapter 518 or audio/video adapter 519.

Expansion bus interface 514 provides a connection for a keyboard and mouse adapter 520, modem 522, and additional memory 524. SCSI host bus adapter 512 provides a connection for hard disk drive 526, tape drive 528, and CD-ROM drive 530. Typical PCI local bus implementations will support three or four PCI expansion slots or add-in connectors.

An operating system runs on processor 502 and is used to coordinate and provide control of various components within data processing system 500 in FIG. 5. The operating system may be a commercially available operating system such as OS/2, which is available from International Business Machines Corporation. "OS/2" is a trademark of International Business Machines Corporation. An object oriented programming system such as Java may run in conjunction with the operating system and provides calls to the operating system from Java programs or applications executing on data processing system 500. "Java" is a trademark of Sun Microsystems, Inc. Instructions for the operating system, the object-oriented operating system, and applications or programs are located on storage devices, such as hard disk drive 526, and may be loaded into main memory 504 for execution by processor 502.

Those of ordinary skill in the art will appreciate that the hardware in FIG. 5 may vary depending on the implementation. Other internal hardware or peripheral devices, such as flash ROM (or equivalent nonvolatile memory) or optical disk drives and the like, may be used in addition to or in place of the hardware depicted in FIG. 5. Also, the processes of the present invention may be applied to a multiprocessor data processing system.

For example, data processing system 500, if optionally configured as a network computer, may not include SCSI host bus adapter 512, hard disk drive 526, tape drive 528, and CD-ROM 530, as noted by dotted line 532 in FIG. 5 denoting optional inclusion. In that case, the computer, to be properly called a client computer, must include some type of network communication interface, such as LAN adapter 510, modem 522, or the like. As another example, data processing system 500 may be a stand-alone system configured to be bootable without relying on some type of network communication interface, whether or not data processing system 500 comprises some type of network communication interface. As a further example, data processing system 500 may be a Personal Digital Assistant (PDA) device which is configured with ROM and/or flash ROM in order to provide non-volatile memory for storing operating system files and/or user-generated data.

The depicted example in FIG. 5 and above-described examples are not meant to imply architectural limitations. For example, data processing system 500 also may be a notebook computer or hand held computer in addition to taking the form of a PDA. Data processing system 500 also may be a kiosk or a Web appliance.

Turning next to FIG. 6, a block diagram illustrating a graphics adapter is depicted in accordance with a preferred embodiment of the present invention. Graphics adapter 600 is an example of a graphics adapter, such as graphics adapter 518 in FIG. 5. Graphics adapter 600 includes an adapter memory 602, a random access memory digital to analog converter (RAMDAC) 604, a color WAT table 606, and an overlay WAT table 608. Adapter memory 602 includes a color frame buffer 610, an overlay frame buffer 612, and a WID buffer 614. The two frame buffers contain pixels, which are sent to RAMDAC 604 for output to a display device. RAMDAC 604 is a graphics controller chip that maintains the color palette and converts data from memory into analog signals for a display device.

WID buffer 614 contains WIDs that are used as an index into color WAT table 606 and overlay WAT table 608. Each of these WAT tables describes how a pixel will be rendered on a display device.

In FIG. 7, an example of a WAT table is depicted in accordance with a preferred embodiment of the present invention. WAT table 700 contains information describing the pixel type, the color map, the buffer, and the gamma for color WATS. WAT Table 700 includes information such as pixel type, color map, and transparency for overlay WATS. WAT table 700, in this example, contains two sets of sixteen entries indexed by a WID. The pixel type in this example describes the pixel type as being an eight bit pixel color or a twenty-four bit true color. Other information that may be included may be, for example, which frame buffer will be displayed, whether the overlay is transparent, or whether the overlay is disabled. These entries may be used in color WAT table 606 and overlay WAT table 608 in FIG. 6.

In this example, only four bits are used as an index into a WAT table. Each table contains sixteen entries, which are indexed by a WID from WID buffer 614 in FIG. 6. This in contrast to an eight bit system in which the WID is split between the color WAT and the overlay WAT. The four bit WID is shared between the overlay and color WAT. So each WID entry will point to an overlay WAT and color WAT. The buffer used to display the pixel on the screen will depend on a setting of the overlay WAT for the WID entry. This setting may be, for example, an opaque overlay, transparent overlay, or overlay disabled.

The present invention provides a method, apparatus, and computer implemented instructions for rendering pixels from two frame buffers using color buffer WIDs and opaque overlay WIDs in which only a single WID buffer is used. The mechanism of the present invention involves creating a region mask, which contains all viewable regions that have opaque overlay pixel types. This mask may be used to mask off unwanted regions when color buffer WIDs are rendered. In these examples, the root window is considered the parent window. A window tree is traversed to find the viewable regions in the overlays. Only the opaque regions in the overlays that will be viewable are unioned or logically ORed together. Only the opaque viewable pixels for the overlays will be masked off to prevent color buffer WIDs from overwriting these overlay WIDs. In this manner the present invention allows the use of a single WID buffer for use in rendering pixels that may be in a color frame buffer and in a overlay frame buffer.

Figures 8, 9:
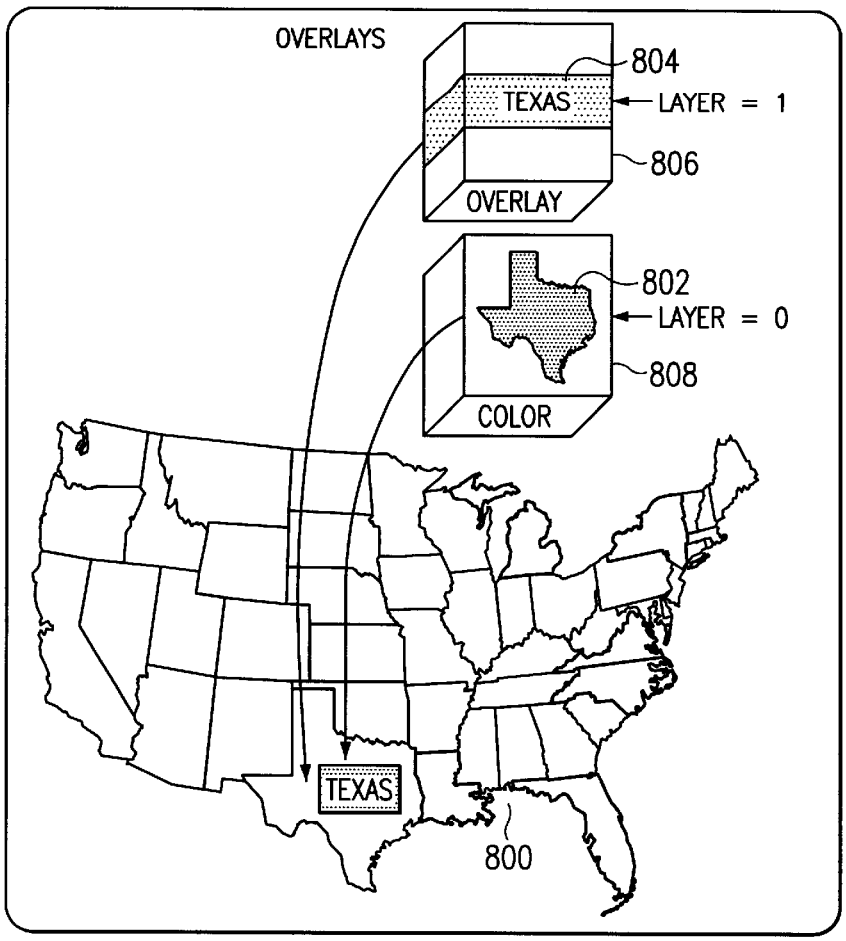
FIG. 8 is an illustration of an overlay in accordance with a preferred embodiment of the present invention.
FIG. 9 is a diagram illustrating a structure used to hold overlay region mask information in accordance with a preferred embodiment of the present invention.

With reference now to FIG. 8, an illustration of an overlay is depicted in accordance with a preferred embodiment of the present invention. In this example, map 800 may be displayed using pixels located in two frame buffers and a single WID buffer. Map 800 includes a set of pixels in a color frame buffer that represent states in map 800. For example, shape 802 is that of the State of Texas. The pixels for shape 802 are located in a color frame buffer, while the text "Texas" 804 is located in a overlay frame buffer. In this example, "Texas" 804 is located in a region 806 in the overlay frame buffer, while shape 802 is located in a region 808 in the color frame buffer. The region where the text is located is opaque, while other portions are transparent.

In this example, when a single WID buffer is used it is desirable to prevent opaque WID information for the region containing "Texas" 804 from being overwritten by WID information for shape 802 because those portions of shape 802 under "Texas" 804 will not be visible on the screen. The present invention prevents this overwriting through the use of an overlay region mask. This overlay region mask is used to prevent color WID information from overwriting opaque overlay WID regions. The overlay region mask is composed of all opaque overlay WID regions.

Turning next to FIG. 9, a diagram illustrating a structure used to hold overlay region mask information is depicted in accordance with a preferred embodiment of the present invention. Data structure 900 is a The _Region structure used to hold the overlay region mask information.

Figure 10:
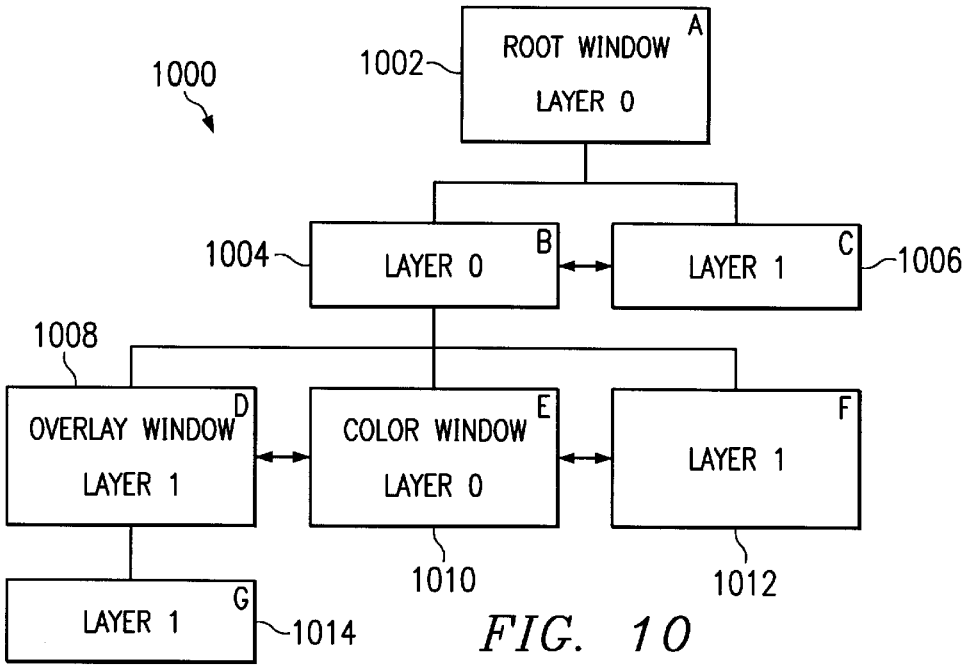
FIG. 10 is a diagram illustrating a window tree in accordance with a preferred embodiment of the present invention.

With reference now to FIG. 10, a diagram illustrating a window tree is depicted in accordance with a preferred embodiment of the present invention. Window tree 1000 is stored within a data structure in a main or host memory of a data processing system. In these examples, window tree 1000 is maintained by an x server. Window tree 1000 includes a root window 1002. Window 1004 and window 1006 are children windows of root window 1002. Window 1004 and window 1006 are called sibling windows in window tree 1000. Windows 1008, 1010, and 1012 are sibling windows to each other and are children windows to window 1004. Window 1014 is a child to window 1008. In this example, window 1002 represents a color or layer 0 window similar to that illustrated in region 808 in FIG. 8. Window 1008, in this example, is an overlay or layer 1 window similar to region 806 in FIG. 8. The other windows may be either layer 0 or layer 1 windows as shown in FIG. 10. With these different windows in window tree 1000, the present invention will identify the parent or root window, as well as processing the different overlay windows.

Figure 11:
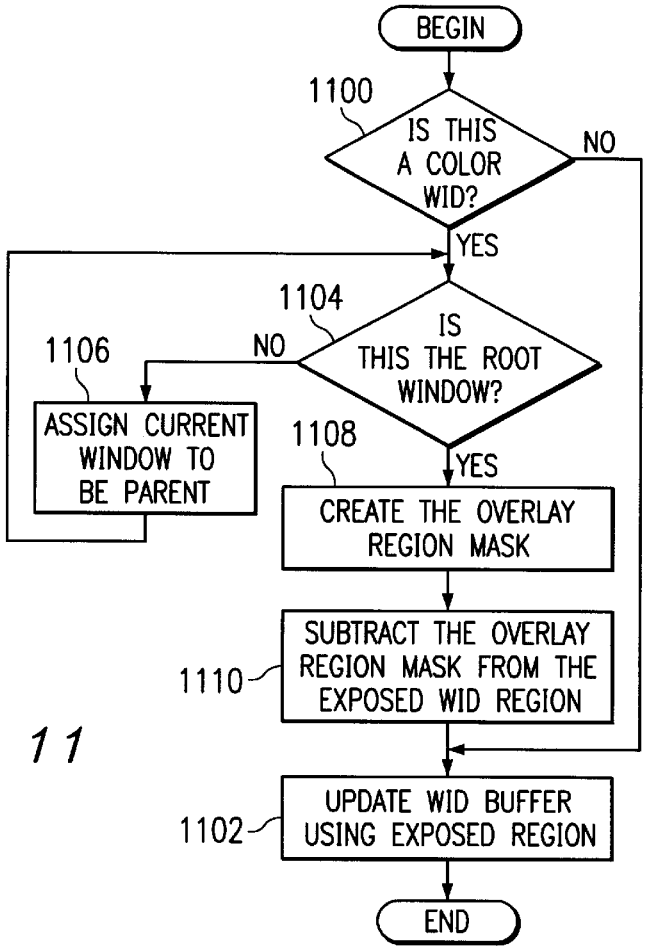
FIG. 11 is a high level flowchart of a process for updating a window ID (WID) buffer in accordance with a preferred embodiment of the present invention.

With reference now to FIG. 11, a high level flowchart of a process for updating a window ID (WID) buffer is depicted in accordance with a preferred embodiment of the present invention. This process is used when a single WID buffer is used in place of a split WID buffer. This process prevents color buffer WIDs from overwriting overlay WIDs.

The process begins by determining whether the WID for the pixel is a color WID (step 1100). If the window is in layer 0, then this is a color WID. It can also be determined by the WID. For example, WIDs 0–4 may be designated as opaque overlay WIDs and WIDs 5–15 may be designated as color WIDs. If the WID is not a color WID, the WID buffer is updated using the overlay exposed region (step 1102) with the process terminating thereafter. The exposed region is present because the WID is for an overlay pixel. With reference again to step 1100, if the WID is a color WID, a determination is made as to whether the window is a root window (step 1104). This step is used to determine whether the root window is being processed. If the window is not the root window, then the current window is assigned to be the parent window (step 1106) with the process then returning the step 1104. This step is used to move the pointer to the window up the window tree.

When the root window is reached, an overlay region mask is created (step 1108). Step 1108 is described in more detail in the description of FIG. 12 below. The overlay region mask is subtracted from the exposed WID region (step 1110) with the process then proceeding to step 1102 as described above. This subtraction causes that portion of the WID buffer in which an opaque overlay is present to remain unchanged by the color WID information.

Figure 12:
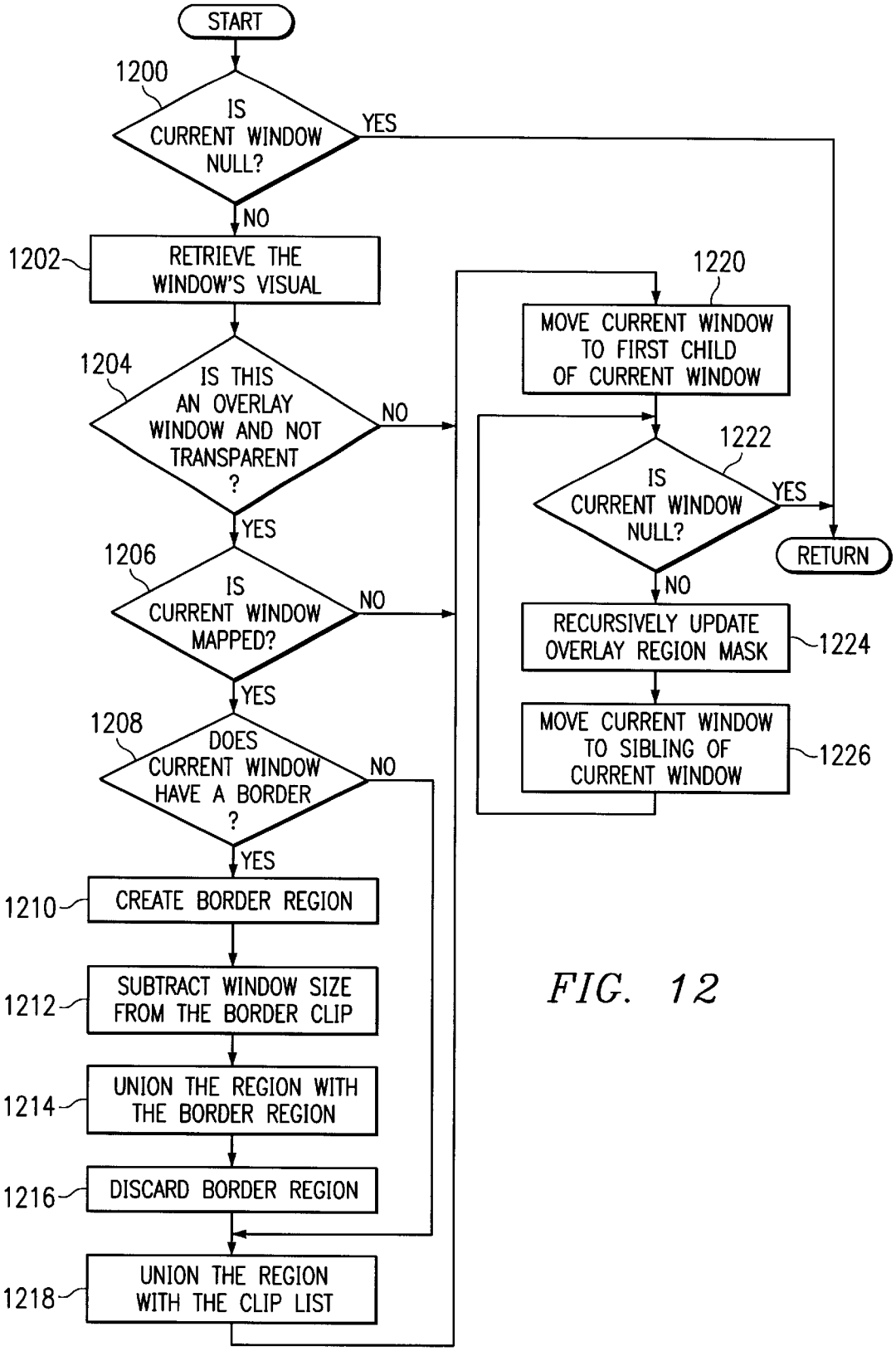
FIG. 12 is a flowchart of a process for creating an overlay region mask in accordance with a preferred embodiment of the present invention.

With reference now to FIG. 12, a flowchart of a process for creating an overlay region mask is depicted in accordance with a preferred embodiment of the present invention. This process is a more detailed description of step 1108 in FIG. 11. The process begins by determining whether the current window is null (step 1200). This step determines whether the pointer is to the root window. If the current window is null, the process terminates. Otherwise, the visual for the window is retrieved (step 1202). The visual is comprised of pixel depth, number of available colors, layer (layer=1 overlay buffer or layer=0 color buffer), transparent_type (opaque overlay or transparent overlay or disabled), valid range of colors, and visual class. Next, a determination is made as to whether the window is an overlay window and is not transparent (step 1204). If the window is an overlay window and is not transparent, a determination is made as to whether the current window is mapped (step 1206). If a window is mapped, it may be viewable. Unmapped windows are never viewable.

If the current window is mapped, then a determination is made as to whether the current window has a border (step 1208). A bordered window is a window that contains a rectangular region larger than the window so that the window is inside the border region. If the current window is borded, a border region is created (step 1210). Then, the window size is subtracted from the border clip (step 1212). The border clip contains the viewable portion of the border after all clipping has been completed. Since the border clip contains the border and everything with in it, the window size has to be subtracted to obtain the border region. The region is then unioned with the border region (step 1214). The region unioned with the border region in step 1214 is the region passed to the process in FIG. 12, which is also called an UpdateoverlayRegionMask function. The first time this function is called the region is passed in as NULL. This function gets called recursively and the region is unioned with itself and the border region as well as the windows clip list. The recursive call occurs in step 1224 below. The boarder region is then discarded (step 1216).

The region is then unioned with itself and the windows clip list (step 1218). The windows clip list contains all viewable regions within the window except for the border which is outside the window. The current window is then moved to the first child of the current window (step 1220). This step is used to move the pointer to the first child of the current window being processed.

A determination is made as to whether the current window is null (step 1222). If the current window is null, the process terminates, otherwise, the overlay region mask is recursively update (step 1224). Step 1224 is a recursive step used to represent an entry into another process starting with step 1200. After this recursive step has completed, the current window is moved to the sibling of the current window (step 1226) with the process then returning to step 1222 as described above.

With reference again to step 1208, if the current window is not boardered, the region is unioned with the clip list (step 1218) with the process then proceeding to step 1220 as described above. Turning back to step 1206, if the current window is not mapped, the process proceeds to step 1220. The process also proceeds to step 1220 if in step 1204, the window is not an overlay window or is transparent.

Turning next to FIGS. 13A and 13B, a diagram of code used to traverse windows and create an overlay region mask is depicted in accordance with a preferred embodiment of the present invention. Code 1300 is used to union all mapped overlay regions including window boarders and its clip list. The code in these examples in C. In particular, the code will traverse a window tree given a parent window as a starting point. While traversing the window tree, if the window is mapped to the screen and the window is an opaque overlay window, the boarder and clip list regions are unioned with the region for the overlay region mask.

Section 1302 in FIG. 13A is used to traverse the different overlay windows. In FIG. 13B, section 1304 in code 1300 is used to subtract a region from the frame buffer WID to prevent the overlay WID from being overwritten by the color WID in that location.

Thus, the present invention provides a method, apparatus, and computer implemented instructions for supporting a single WID buffer in which color buffer WIDs are prevented from overwriting overlay WIDs in the WID buffer when the overlay WID is not transparent. The present invention provides this advantage through the use of a opaque overlay mask as described above. In this manner, the same functionality as split WIDs is provided. Further, the number of WIDs that may be provided in hardware is increased.

It is important to note that while the present invention has been described in the context of a fully functioning data processing system, those of ordinary skill in the art will appreciate that the processes of the present invention are capable of being distributed in a form of a computer readable medium of instructions and a variety of forms and that the present invention applies equally regardless of the particular type of signal bearing media actually used to carry out the distribution. Examples of computer readable media include recordable-type media such a floppy disc, a hard disk drive, a RAM, CD-ROMs, and transmission-type media such as digital and analog communications links.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention the practical application and to enable others of ordinary skill in the art to understand the invention for various embodiments with various modifications as are suited to the particular use contemplated.

What is claimed is:

1. A method in a data processing system for updating a buffer used to display pixels from a first layer and a second layer in the data processing system, wherein identification display information for pixels from the first layer and the second layer are stored in the buffer, the method comprising:

identifying pixels for the second layer having opaque pixel types to form a selected set of pixels; and preventing overwriting of display information for the selected set of pixels in the buffer when updating the buffer includes:

creating a mask containing all regions of viewable pixels having opaque pixel types in the second layer; and updating the buffer using the mask to mask portions of the buffer containing display information for the all regions of viewable pixels having opaque pixel types in the second layer, wherein display information for pixels in the first layer are only written into unmasked portions of the buffer.

2. A method in a data processing system for updating a buffer used to display pixels from a first layer and a second layer in the data processing system, wherein identification display information for pixels from the first layer and the second layer are stored in the buffer, the method comprising:

identifying pixels for the second layer having opaque pixel types to form a selected set of pixels; and preventing overwriting of display information for the selected set of pixels in the buffer when updating the buffer includes;

creating a mask containing all regions of viewable pixels having opaque pixel types in the second layer; and updating the buffer using the mask to mask portions of the buffer containing display information for the all regions of viewable pixels having opaque pixel types in the second layer, wherein display information for pixels in the first layer are only written into unmasked portions of the buffer, wherein a plurality of windows are present including a root window and wherein the step of creating the mask includes identifying all regions of viewable pixels having opaque pixel types in the second layer for every window.

3. A method in a data processing system for updating a buffer containing display information for a first layer and a second layer, the method comprising the data processing system implemented steps of:

creating a mask containing all viewable regions in the second layer having a nontransparent pixel type; and updating the buffer using the mask, wherein display information for the second layer remains unchanged in portions of the buffer blocked by the mask.

4. The method of claim 3, wherein the display information is a set of window identifiers.

5. The method of claim 4, wherein the set of window identifiers serve as an index into a window attribute table used to display pixels associated with the window identifiers.

6. The method of claim 3, wherein the display information for the first layer are color window identifiers and the display information for the second layer are overlay window identifiers.

7. A display apparatus comprising:

a first frame buffer for storing a first set of pixels;

a second frame buffer for storing a second set of pixels;

a first window attribute table storing display information;

a second window attribute table storing display information;

a window identifier buffer connected to the first window attribute table and the second window attribute table, wherein the window identifier buffer stores window identifiers used to identify display information for the first set of pixels and for the second set of pixels;

a random access memory digital to analog converter unit connected to the first frame buffer, the second frame buffer, the first window attribute table, and the second window attribute table and having a connection configured to connection to a display device, wherein the random access memory digital to analog converter unit receives pixels for display from the first frame buffer and the second frame buffer and displays the pixels using display information from the first window attribute table and the second window attribute table; and a processing unit, wherein the processing unit creates a mask containing all viewable regions for pixels in the second frame buffer having a nontransparent pixel type and updates the window identifier buffer using the mask, wherein display information for the pixels in the second frame buffer remains unchanged in portions of the buffer blocked by the mask.

8. The display apparatus of claim 7, wherein the display apparatus is a graphics adapter and where the processing unit is a processor located on the graphics adapter.

9. The display apparatus of claim 7, wherein the display apparatus is a computer and wherein the first frame buffer, the second frame buffer, the first window attribute table, the second window attribute table, and the window identifier buffer are located in a graphics adapter in the computer and the processing unit is a central processing unit in the computer.

10. A data processing system for updating a buffer used to display pixels from a first layer and a second layer in the data processing system, wherein identification display information for pixels from the first layer and the second layer are stored in the buffer, the data processing system comprising:

identifying means for identifying pixels for the second layer having opaque pixel types to form a selected set of pixels; and preventing means for preventing overwriting of display information for the selected set of pixels in the buffer when updating the buffer in which the preventing means includes:

creating means for creating a mask containing all regions of viewable pixels having opaque pixel types in the second layer; and updating means for updating the buffer using the mask to mask portions of the buffer containing display information for the all regions of viewable pixels having opaque pixel types in the second layer, wherein display information for pixels in the first layer are only written into unmasked portions of the buffer.

11. A data processing system for updating a buffer used to display pixels from a first layer and a second layer in the data processing system, wherein identification display information for pixels from the first layer and the second layer are stored in the buffer, the data processing system comprising:

identifying means for identifying pixels for the second layer having opaque pixel types to form a selected set of pixels; and preventing means for preventing overwriting of display information for the selected set of pixels in the buffer when updating the buffer in which the preventing means includes:

creating means for creating a mask containing all regions of viewable pixels having opaque pixel types in the second layer; and updating means for updating the buffer using the mask to mask portions of the buffer containing display information for the all regions of viewable pixels having opaque pixel types in the second layer, wherein display information for pixels in the first layer are only written into unmasked portions of the buffer, wherein a plurality of windows are present including a root window and wherein the means of creating the mask includes identifying all regions of viewable pixels having opaque pixel types in the second layer.

12. A data processing system for updating a buffer containing display information for a first layer and a second layer, the data processing system comprising:

creating means for creating a mask containing all viewable regions in the second layer having a nontransparent pixel type; and updating means for updating the buffer using the mask, wherein display information for the second layer remains unchanged in portions of the buffer blocked by the mask.

13. The data processing system of claim 12, wherein the display information is a set of window identifiers.

14. The data processing system of claim 13, wherein the set of window identifiers serve as an index into a window attribute table used to display pixels associated with the window identifiers.

15. The data processing system of claim 12, wherein the display information for the first layer are color window identifiers and the display information for the second layer are overlay window identifiers.

16. A computer program product in a computer readable medium for updating a buffer containing display information for a first layer and a second layer, the computer program product comprising:

first instructions for creating a mask containing all viewable regions in the second layer having a nontransparent pixel type; and second instructions for updating the buffer using the mask, wherein display information for the second layer remains unchanged in portions of the buffer blocked by the mask.

* * * * *